US005860826A

United States Patent [19]

Chang

[11] Patent Number: 5,860,826

[45] Date of Patent: Jan. 19, 1999

[54] ELECTRIC CONNECTOR FASTENER

[76] Inventor: Warren Chang, No.24,Lane 20, Shuang Cherng Road, Hsintien, Taipei Hsien, Taiwan

[21] Appl. No.: 917,182

[22] Filed: Aug. 25, 1997

[51] Int. Cl.[6] ..... H01R 13/627

[52] U.S. Cl. ..... 439/358

[58] Field of Search ..... 439/350–355, 439/357, 358, 372

[56] References Cited

U.S. PATENT DOCUMENTS

| | | | |
|---|---|---|---|
| 5,178,556 | 1/1993 | Chen | 439/357 |
| 5,201,669 | 4/1993 | Lin | 439/357 |
| 5,234,357 | 8/1993 | Yamaguchi | 439/354 |
| 5,716,228 | 2/1998 | Chen | 439/358 |

*Primary Examiner*—Khiem Nguyen

*Attorney, Agent, or Firm*—Donald C. Casey, Esq.

[57] ABSTRACT

An electric connector fastener including a female retaining plate made for fastening up with a male retaining plate, and a press block fastened to the female retaining plate for release control, the female retaining plate having a hook hole extended from an angled front end thereof adapted for receiving the male retaining plate, an arched notch at an inner side of its angled front end in communication with the hook hole for engagement with a raised portion of the male retaining plate, an axle housing transversely disposed in the middle for installation, a returned springy tail having an angled end piece, and two retaining holes longitudinally spaced between the springy tail and the axle housing, the press block having a longitudinal track defined within a bottom channel thereof into which a part of the female retaining plate is inserted, and two sloping retainer blocks spaced inside the bottom channel and respectively forced into engagement with the retaining holes of the female retaining plate.

1 Claim, 6 Drawing Sheets

ELECTRIC CONNECTOR FASTENER

BACKGROUND OF THE INVENTION

The present invention relates to electric connector fasteners adapted for use in an electric connector for securing it to a matching electric connector.

FIG. 1 shows a female retaining plate 10 adapted for use in a first electric connector for engagement with a male retaining plate 21 of a second electric connector 20. The female retaining plate 10 comprises a hook hole 11 at one end, an axle housing 12 transversely disposed in the middle, a press portion 14 at an opposite end, and a projecting spring strip 13 spaced between the press portion 14 and the axle housing 12. The male retaining plate 21 comprises a screw 25 mounted in a hole in the connector 20, a projecting strip 22, a raised portion 23 raised from the projecting strip 22 at one side. When the two electric connectors are connected together, the raised portion 23 of the male retaining plate 20 is forced into engagement with the hook hole 11 of the female retaining plate 10. When to disconnect the two electric connectors, the press portion 14 is depressed to force the hook hole 11 out of the raised portion 23. The drawback of the aforesaid arrangement is that the raised portion 23 of the male retaining plate 21 tends to be forced out of the hook hole 11 of the female retaining plate 10, causing a connection error. Further, because the female retaining plate 10 is a metal plate and the press portion 14 is not electrically insulated, it is dangerous to operate the press portion 14 with the hand when power supply is not turned off.

SUMMARY OF THE INVENTION

The present invention has been accomplished to provide an electric connector fastener which eliminates the aforesaid drawbacks. According to the preferred embodiment of the present invention, the electric connector fastener comprises a female retaining plate made for fastening up with a male retaining plate, and a press block fastened to the female retaining plate for release control. The female retaining plate comprises a hook hole extended from an angled front end thereof adapted for receiving the male retaining plate, an arched notch at an inner side of its angled front end in communication with the hook hole for engagement with a raised portion of the male retaining plate, an axle housing transversely disposed in the middle for installation, a returned springy tail having an angled end piece, and two retaining holes longitudinally spaced between the springy tail and the axle housing. The press block comprises a longitudinal track defined within a bottom channel thereof into which a part of the female retaining plate is inserted, and two sloping retainer blocks spaced inside the bottom channel and respectively forced into engagement with the retaining holes of the female retaining plate.

DETAILED DESCRIPTION OF THE PREFERRED EMBODIMENT

Figure 1:
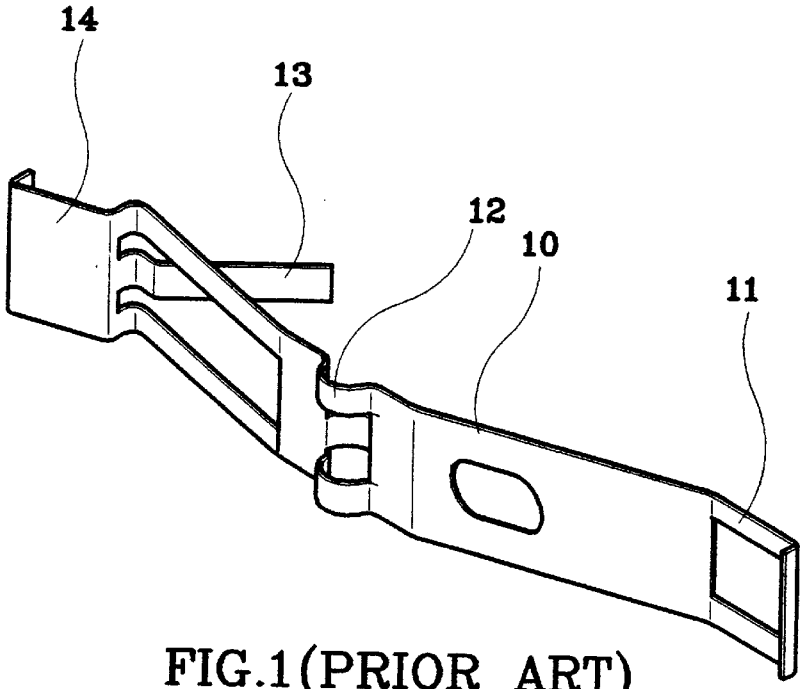
FIG.1(PRIOR ART)
FIG. 1 is an elevational view of a female retaining plate for an electric connector according to the prior art.
Figure 2:
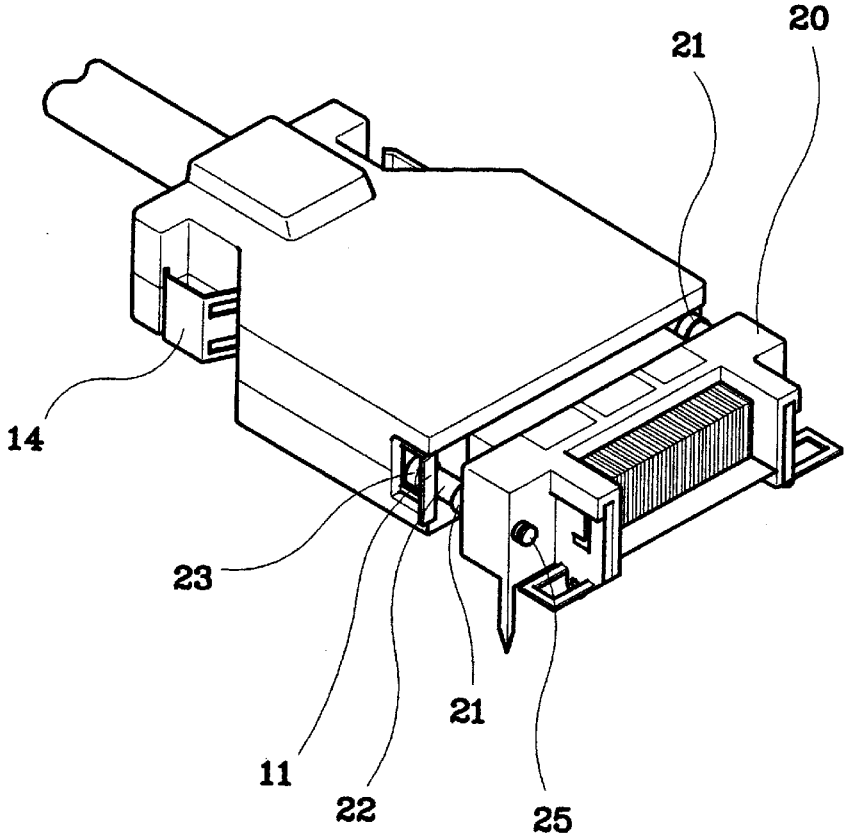
FIG.2(PRIOR ART)
FIG. 2 shows female retaining plates and male retaining plates of two matched electric connectors fastened together according to the prior art.
Figure 3:
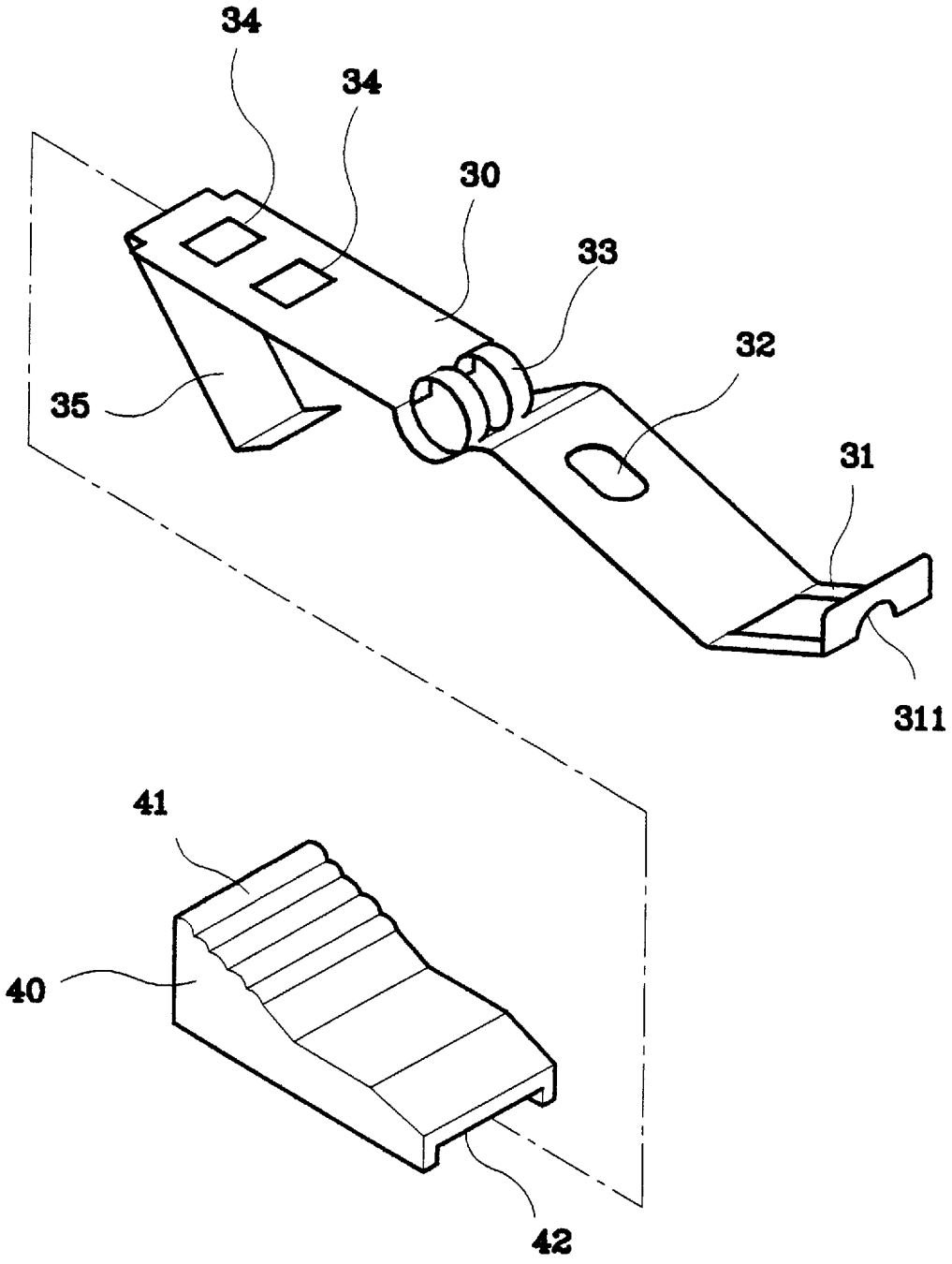
FIG. 3 is an exploded view of an electric connector fastener according to the present invention.
Figure 4:
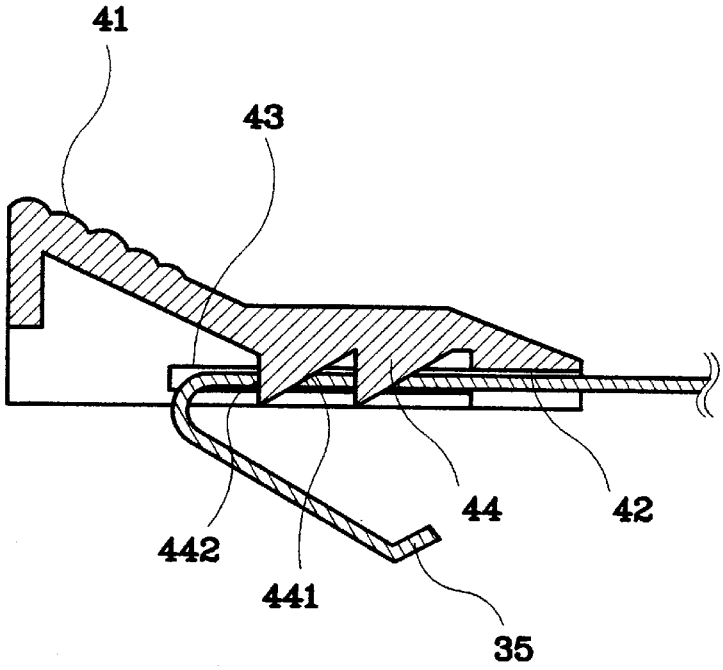
FIG. 4 is a sectional assembly view of the electric connector fastener shown in FIG. 3.

Referring to FIGS. 3 and 4, an electric connector fastener in accordance with the present invention comprises a female retaining plate 30, and a press block 40. The female retaining plate 30 is made from a thin metal plate, comprising a hook hole 31 extended from its angled front end, an arched notch 311 at an inner side of its angled front end in communication with the hook hole 31, an axle housing 33 transversely disposed in the middle, a recess 32 disposed between the hook hole 31 and the axle housing 33, a returned springy tail 35, and two retaining holes 34 longitudinally spaced between the springy tail 35 and the axle housing 33. The press block 41 is a plastic wedge block having a bottom channel 42 longitudinally disposed at its bottom side, a plurality of anti-skid ribs 41 transversely disposed at its top side, a longitudinal track 43 defined within the bottom channel 42, and two retainer blocks 44 spaced inside the bottom channel 42, each retainer block 44 having a sloping front side 441 and a vertical rear side 442. The press block 40 is fastened to the female retaining plate 30. When the rear end of the female retaining plate 30 is inserted into longitudinal track 43 of the bottom channel 42 of the press block 40, the retaining holes 34 pass over the sloping front sides 441 of the retainer blocks 44 in proper order, and then the retaining holes 34 are respectively forced into engagement with the retainer blocks 44, and therefore the press block 40 and the female retaining plate 30 are fastened together.

Figure 5A:
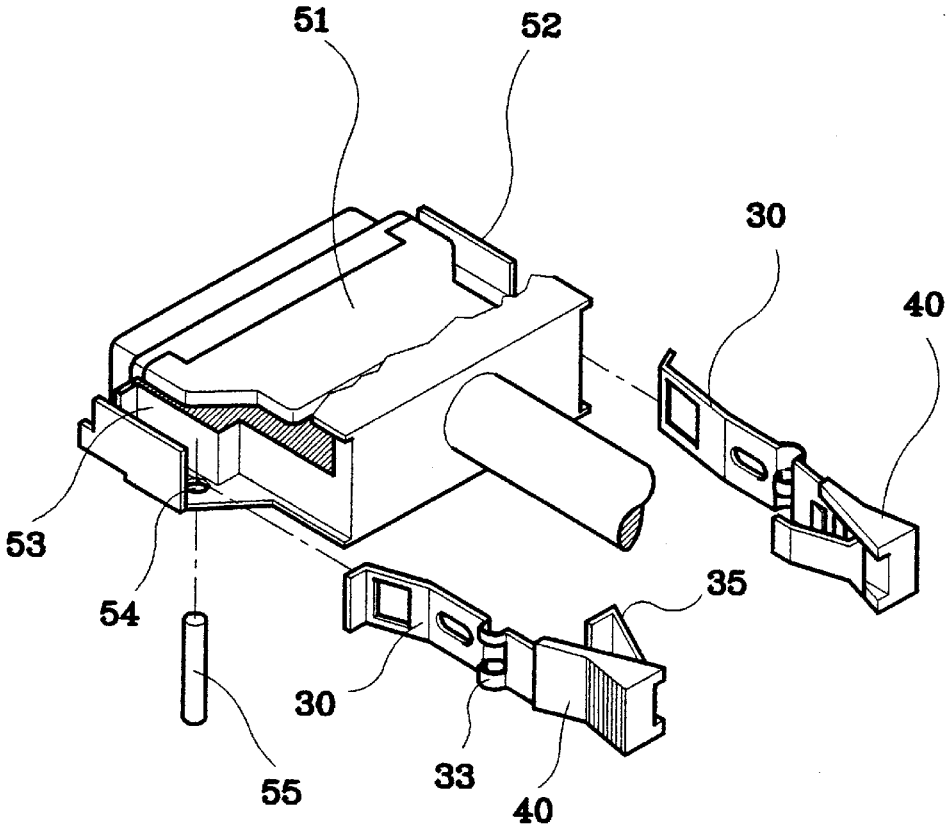
FIG. 5A is an exploded view of an electric connector with electric connector fasteners according to the present invention.
Figure 5B:
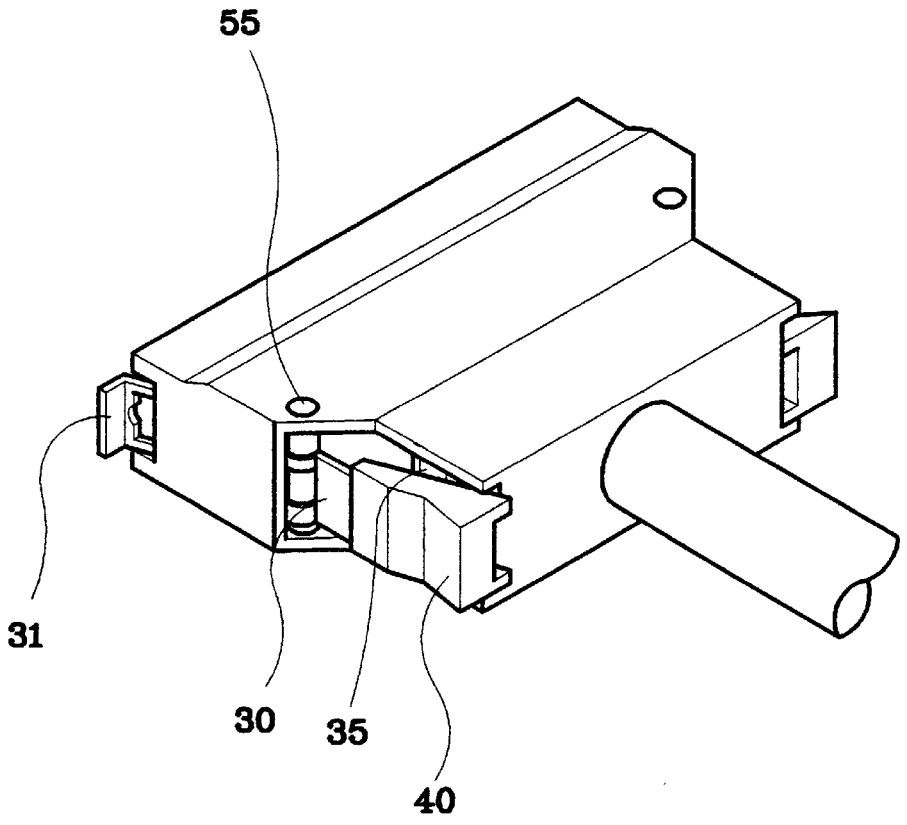
FIG. 5B is an assembly view of FIG. 5A.

Referring to FIGS. 5A and 5B, two electric connector fasteners are installed in an electric connector 50. The electric connector 50 comprises a PE (polyethylene) inner shell 51, a PVC (polyvinyl chloride) outer shell 52 covered over the PE inner shell 51, two axial chambers 53 defined within the PVC outer shell 52 at two opposite sides outside the PE inner shell 51, and two pin holes 54 bilaterally disposed at the PVC outer shell 52 in communication with the axial chambers 53. The female retaining plates 30 of the electric connector fasteners are respectively inserted into the axial chambers 53. Two locating pins 55 are respectively inserted into the pin holes 54 of the PVC outer shell 52 and the axle housings 33 of the female retaining plates 30 to secure the electric connector fasteners in place, permitting the returned springy tails 35 of the female retaining plates 30 of the electric connector fasteners to be stopped at the periphery of the axial chambers 53.

Figure 6:
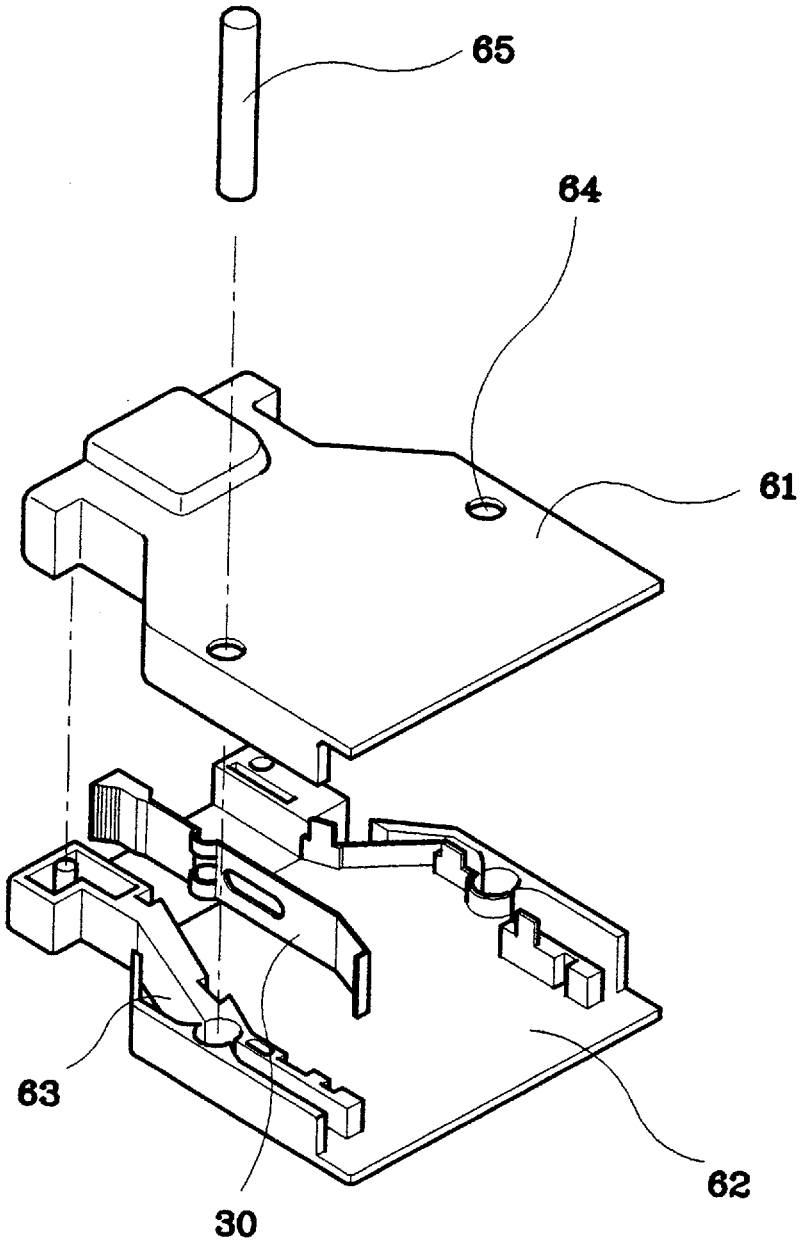
FIG. 6 is an exploded view of another structure of electric connector with electric connector fasteners according to the present invention.

FIG. 6 shows another application example of the present invention. According to this application example, the electric connector is comprised of an upper shell 61 and a bottom shell 62 fastened together. The electric connector comprises two axial chambers 63 bilaterally disposed on the inside, and two pin holes 64 respectively intersected with the axial chambers 63. Two locating pins 65 are respectively mounted in the pin holes 64 of the electric connector and the transverse axle housings 33 of the female retaining plates 30 of the electric connector fasteners to secure the electric connector fasteners in place.

Figure 7A:
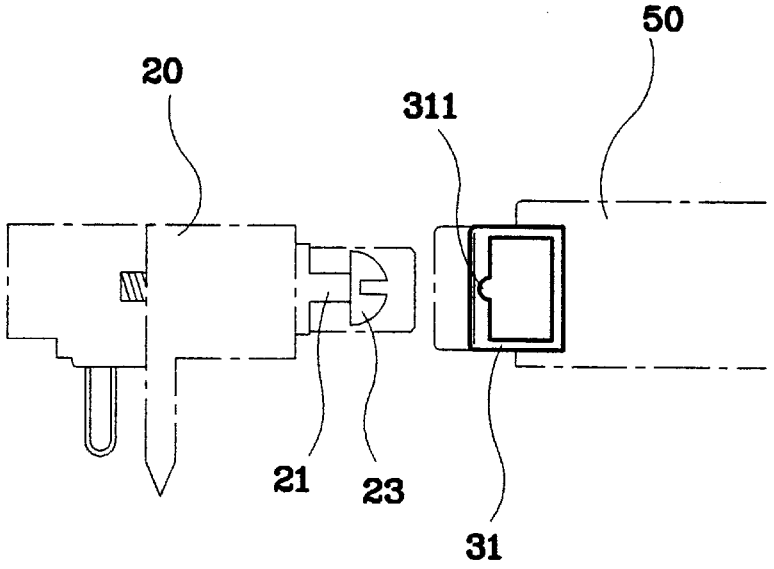
FIG. 7A is an applied view of the present invention, showing the connection between two electric connectors (before connection)
Figure 7B:
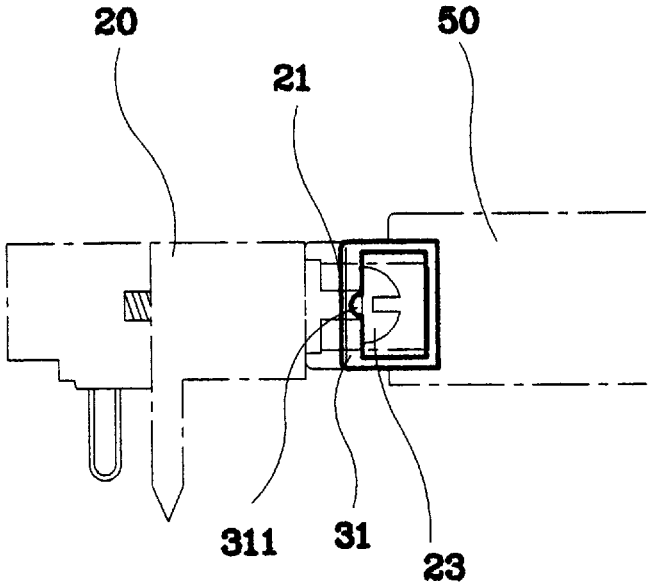
FIG. 7B is similar to FIG. 7A but showing the electric connectors fastened together.
Figure 7C:
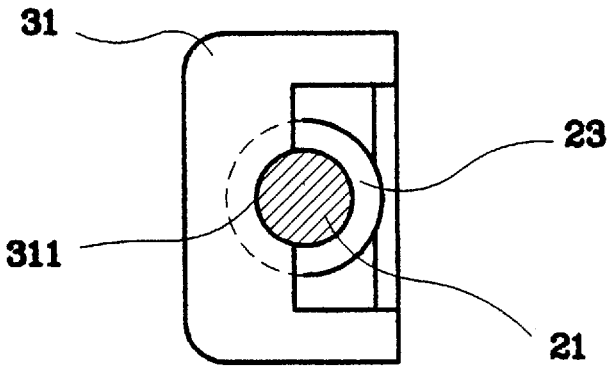
FIG. 7C shows the engagement between the raised portion of the male retaining plate and the arched notch of the female retaining plate according to the present invention.

Referring to FIGS. 7A, 7B and 7C, when the electric connector 50 is connected to a matching electric connector 20, the raised portion 23 of the male retaining plates 21 of the electric connector 20 are respectively inserted into the hook holes 31 of the female retaining plates 30 and forced into engagement with the arched notches 311 of the female retaining plates 30, and therefore the electric connectors 20;50 are firmly retained together (see FIGS. 7A and 7B). When the press blocks 41 are depressed, the female retaining plates 30 of the electric connector 50 are turned about the respective locating pins 55 to force the hook holes 31 of the female retaining plates 30 away from the raised portions 23 of the male retaining plates 21 of the electric connector 20, and therefore the electric connectors 20;50 are disconnected from each other.

It is to be understood that the drawings are designed for purposes of illustration only, and are not intended as a definition of the limits and scope of the invention disclosed.

What the invention claimed is:

1. An electric connector fastener, comprising a female retaining plate made from a thin metal plate and adapted for fastening up with a male retaining plate, and a press block fastened to said female retaining plate for pressing by hand for release control, said female retaining plate comprising a hook hole extended from an angled front end thereof adapted for receiving said male retaining plate, an arched notch at an inner side of its angled front end in communication with said hook hole for engagement with a raised portion of said male retaining plate, an axle housing transversely disposed in the middle for installation, a recess disposed between said hook hole and said axle housing at one side, a returned springy tail having an angled end piece, and two retaining holes longitudinally spaced between said springy tail and said axle housing, said press block being a plastic wedge block having a plurality of anti-skid ribs transversely disposed at a top side thereof, a longitudinal track defined within a bottom channel thereof into which a part of said female retaining plate is inserted, and two retainer blocks spaced inside said bottom channel and respectively forced into engagement with the retaining holes of said female retaining plate, each of said retainer blocks having a sloping front side and a vertical rear side.

* * * * *